US008123596B2

(12) United States Patent
Kobayashi et al.

(10) Patent No.: US 8,123,596 B2
(45) Date of Patent: Feb. 28, 2012

(54) POWER TOOLS

(75) Inventors: Eiji Kobayashi, Anjo (JP); Yasutaka Yamada, Anjo (JP); Hitoshi Sengiku, Anjo (JP); Akira Tomonaga, Anjo (JP); Hironori Ogura, Anjo (JP); Akira Hachisuka, Anjo (JP)

(73) Assignee: Makita Corporation, Anjo-shi (JP)

( * ) Notice: Subject to any disclaimer, the term of this patent is extended or adjusted under 35 U.S.C. 154(b) by 810 days.

(21) Appl. No.: 12/153,427

(22) Filed: May 19, 2008

(65) Prior Publication Data

US 2008/0305728 A1 Dec. 11, 2008

(30) Foreign Application Priority Data

Jun. 7, 2007 (JP) ..... 2007-151437

(51) Int. Cl.
*B24B 23/00* (2006.01)

(52) U.S. Cl. ..... 451/344; 451/355; 451/449; 451/451

(58) Field of Classification Search ..... 451/344, 451/355–359, 449, 451
See application file for complete search history.

(56) References Cited

U.S. PATENT DOCUMENTS

| | | | |
|---|---|---|---|
| 1,963,448 | A | 6/1934 | Robbins |
| 4,932,366 | A | 6/1990 | Zerrer |
| 5,315,193 | A | 5/1994 | Kummer et al. |
| 2004/0124721 | A1 | 7/2004 | Pfisterer et al. |

FOREIGN PATENT DOCUMENTS

| | | | |
|---|---|---|---|
| DE | 3821951 | A1 | 1/1990 |
| EP | 1 398 865 | A2 | 3/2004 |
| EP | 1 491 290 | A1 | 12/2004 |
| GB | 2 383 007 | A | 6/2003 |
| JP | A-09-272073 | | 10/1997 |
| JP | A-11-33934 | | 2/1999 |
| JP | A-2002-018745 | | 1/2002 |

*Primary Examiner* — Maurina Rachuba
(74) *Attorney, Agent, or Firm* — Oliff & Berridge

(57) ABSTRACT

A power tool includes an air introduction device that can introduce an external air into the casing and can produce a spiral flow of the air within the casing. A motor is disposed within the casing.

14 Claims, 3 Drawing Sheets

POWER TOOLS

This application claims priority to Japanese patent application serial number 2007-151437, the contents of which are incorporated herein by reference.

BACKGROUND OF THE INVENTION

1. Field of the Invention

The present invention relates to power tools, such as disk grinders, and in particular, to power tools having an air introduction device for cooling a motor.

2. Description of the Related Art

A disk grinder is known that has a cylindrical body casing and an electric motor disposed within the body casing as a drive source. The body casing is adapted to be grasped by an operator. An output shaft of the electric motor is supported by a front casing that is disposed on the front side of the body casing. The rotation of the output shaft is transmitted to a spindle. A circular rotary grinding disk is attached to the front portion of the spindle. A rear casing is disposed on the rear side of the body casing. An inlet opening for introducing air is formed in the rear casing. A cooling fan is attached to the output shaft of the motor, so that a flow of the air from the rear side to the front side of the body casing is produced as the fan rotates. Therefore, the air can cool components of the motor. More specifically, the external air enters the rear casing via the inlet opening, flows into the body casing, and is then discharged from an outlet opening formed in the front portion of the body casing.

Techniques for channelling air into the body casing are disclosed in Japanese Laid-Open Patent Publications Nos. 9-272073 and 2002-18745. In these publications, the inlet opening is formed in a side portion of the rear casing.

It has been also known to attach a net-like filter to the inlet opening for preventing dust in the air from entering into the body casing through the inlet opening. However, the filter may increase resistance against flow of the air through the inlet opening and thus causes reduction in the flow rate of the cooling air. A proposed solution is to provide a plurality of guide plates 52 with respective shielding plates 53 as shown in FIG. 4. In the arrangement shown in FIG. 4, a plurality of inlet openings 51 are formed in opposite sides of a rear casing 50. The guide plates 52 extend horizontally and inwardly from an inner wall of the rear casing 50 at positions adjacent to the inlet openings 51. The shielding plates 53 are formed by upwardly bending the innermost ends of the guide plates 52. With this configuration, the dust in the external air entering the inlet openings 51 may collide with the shielding plates 53, so that the dust can be separated from the flow of the air. Hence, it is possible to introduce the external air into the rear casing 50 without substantial increase in the flow resistance, and therefore, a sufficient flow rate of the air containing a small amount of dust can be ensured.

However, according to the arrangement shown in FIG. 4, because all the shielding plates 53 extend upward toward the upper region of the rear casing 50, the flow of the air entering the rear casing 50 from its left side and the flow of the air entering the rear casing 50 from its right side may collide with each other within the upper region of the rear casing 50. In addition, some of the dust may not be shielded by the shielding plates 53 but may enter the upper region of the rear casing 50 with the flow of the air entering from both right and left sides of the rear casing 50 as shown in FIG. 4. Therefore, the dust carried by the flow of the air entering from the right side of the rear casing 50 and the dust carried by the flow of the air entering from the left side of the rear casing 50 may collide with each other, so that the dust may aggregate within the upper region of the rear casing 50 as indicated by a region D.

In general, functional elements of the motor, such as a commutator and carbon brushes are disposed within or near the upper region of the rear casing 50. Therefore, if the amount of the aggregate dust within the upper region of the rear casing 50 increases, it is possible that the motor may malfunction because of the build-up of particulate.

Therefore, there has been a need for a power tool including an air introduction device that can introduce an external air into a casing without causing potential aggregation of dust within the casing.

SUMMARY OF THE INVENTION

One aspect according to the present invention includes a power tool having an air introduction device that can introduce an external air into the casing and produce a spiral flow of the air within the casing. This can prevent or minimize the deposition of dust, which may be carried by the air entering the casing, to components of a motor disposed within the casing.

DETAILED DESCRIPTION OF THE INVENTION

Figure 1:
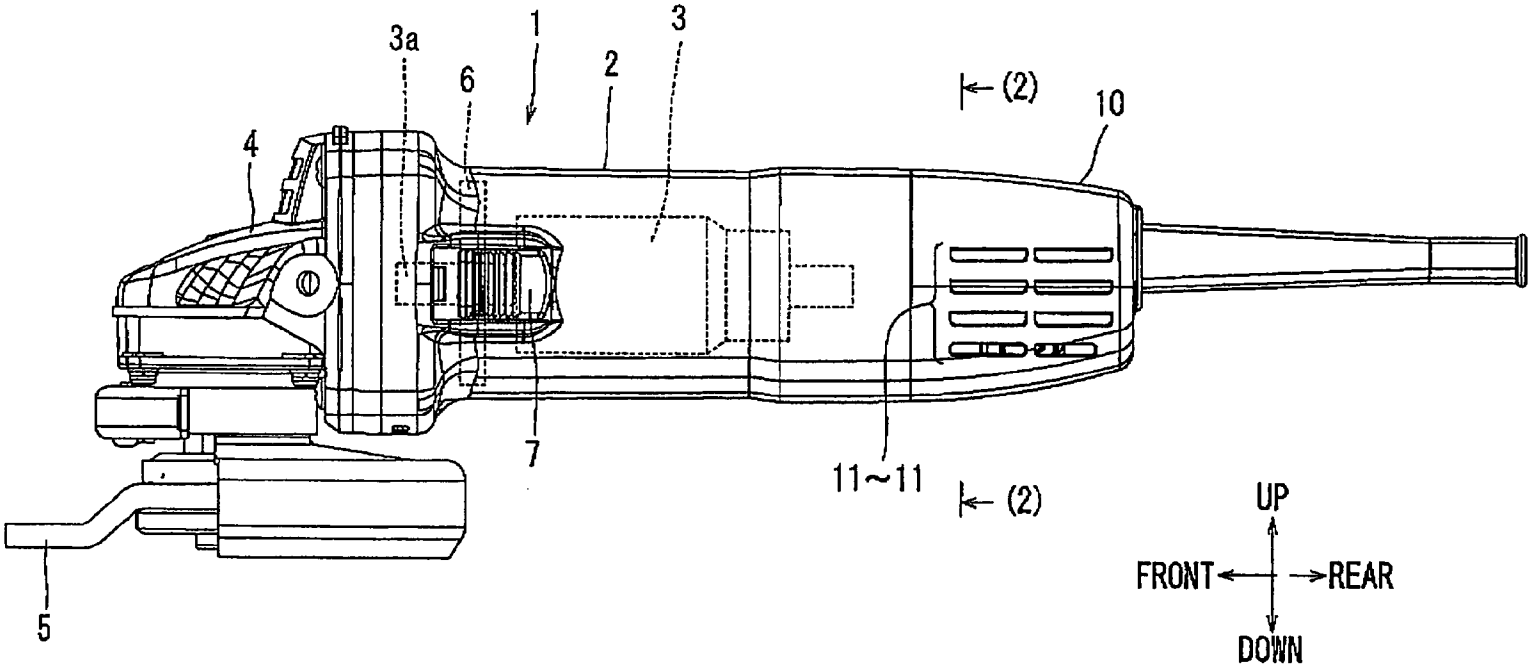
FIG. 1 is a left side view of a power tool according to an embodiment of the present invention.

Each of the additional features and teachings disclosed above and below may be utilized separately or in conjunction with other features and teachings to provide improved power tools. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

In one embodiment, a power tool includes a casing, a motor disposed within the casing, and a first air introduction opening and a second air introduction opening formed in the casing on a first side and a second side opposite to the first side, respectively. The power tool further includes a first air introduction member and a second air introduction member extending inwardly from an inner wall of the casing at positions proximal to the first air introduction opening and the second air introduction opening, respectively. The first air introduction member is configured such that an external air flowing into inside of the casing via the first air introduction opening is directed in a first direction within the casing. The second air introduction member is configured such that an external air flowing into inside of the casing via the second air introduction opening is directed in a second direction within the casing. The first direction and the second direction are the same with respect to a circumferential direction of the casing.

With this arrangement, the air flowing into inside of the casing via the first air introduction opening may not collide with the air flowing into inside of the casing via the second air introduction opening but may merge therewith, so that the air flows in a spiral form within the casing. Therefore, any dust that may be contained in the air entering the casing can be prevented from aggregation within the casing and may not be deposited on components of the motor. With this configuration, it is possible to reduce or prevent malfunctions of the motor.

Further, any dust that may be contained in the air entering the casing can be smoothly discharged from the casing as it is carried by the spiral flow of the air. Therefore, it is possible to reduce the dust that may not be discharged from the casing but is remained within the casing.

The first side and the second side may be a left side and a right side of the casing, respectively, and the first direction and the second direction may be an upward direction and a downward direction, respectively. The first air introduction member may extend from an inner wall of the casing at a position proximal to the lower side of the first air introduction opening; and the second air introduction member may extend from the inner wall of the casing at a position proximal to the upper side of the second air introduction opening.

The first direction and the second direction may be determined such that the air entering the casing via the first and second air introduction openings flows in a spiral form within the casing in the same direction as a rotational direction of the motor. With this arrangement, the air can further smoothly flow through the casing.

The first air introduction member may include a first air introduction plate extending from the inner wall of the casing and inclined upward toward the inside of the casing. The second air introduction member may include a second air introduction plate extending from the inner wall of the casing and inclined downward toward the inside of the casing.

Alternatively, the first air introduction member may include a first air introduction plate extending substantially horizontally from the inner wall of the casing and a first shielding plate extending upward from an innermost end of the first air introduction plate. The second air introduction member may include a second air introduction plate extending substantially horizontally from the inner wall of the casing and a second shielding plate extending downward from an innermost end of the second air introduction plate.

In another embodiment, a power tool includes a casing, a motor disposed within the casing, and an air introduction device that can introduce an external air into the casing and can produce a spiral flow of the air within the casing.

The air introduction device may include a first air introduction device and a second air introduction device. The first air introduction device is disposed on a first side of the casing and is constructed to produce a flow of the air within the casing in a first direction with respect to a circumferential direction of the casing. The second air introduction device is disposed on a second side of the casing opposite to the first side and is constructed to produce a flow of the air within the casing in a second direction with respect to the circumferential direction of the casing. The first direction and the second direction are the same with each other, so that the flow of the air from the first air introduction device and the flow of the air from the second air introduction device are merged to produce the spiral flow.

The casing may include a first case and a second case coupled to each other and each defining a flow path therein. The motor is disposed within the first case, and the air introduction device is disposed at the second case The air introduction device may further include a fan rotatably driven by the motor, so that the external air is drawn into the casing as the fan rotates.

An embodiment of the present invention will now be described with reference to FIGS. 1 to 3. Referring to FIG. 1, a disk grinder 1 is shown as an example of a power tool. The disk grinder 1 has a tool casing including a body casing 2, a front casing 4 and a rear casing 10. An electric motor 3 (as a drive source) is disposed within the body casing 2. The front casing 4 is attached to the front portion of the body casing 2. The rear casing 10 is attached to the rear portion of the body casing 2.

A spindle (not shown) is supported within the front casing 4 and is rotatable about an axis perpendicular to the rotational axis of the motor 3. A disk-like grinding wheel 5 is mounted to the front end of the spindle.

The body casing 2 has a substantially cylindrical tubular configuration. A main switch 7 is mounted to the upper portion of the body casing 2 and is operable to start and stop the motor 3. A plurality of first air introduction openings 11 are formed in the left sidewall of the rear casing 10. Similarly, a plurality of second air introduction openings 12 are formed in the right side wall of the rear casing 10.

A cooling fan 6 is attached to an output shaft 3*a* of the motor 3, so that the fan 6 rotates as the motor 3 is driven. The rotating fan 6 may produce a flow of air from the rear side to the front side (from the right side to the left side as viewed in FIG. 1) within the body casing 2 and the rear casing 10, so that that the motor 3 can be cooled by the flow of air. The air may enter the rear casing 10 from the outside via the first and second air introduction openings 11 and 12 formed in the rear casing 10.

FIG. 1 shows the left side of the rear casing 10. As shown in FIG. 1, in this embodiment, eight first air introduction openings 11 are formed in the rear casing 10 and each are configured as a through hole elongated in the forward and rearward directions (left and right directions in FIG. 1), which is parallel to the motor axis or the output shaft 3*a* of the motor 3. The first air introduction openings 11 are arranged in four rows in the vertical direction and each row includes two first air introduction openings 11 arranged in the forward and rearward directions. A plurality of first air introduction plates 11*a* are formed on the inner wall of the rear casing 10 at positions adjacent to the lower edges of the first air introduction openings 11 in first to third rows from above of the rear casing 10. The first air introduction plates 11*a* extend inwardly of the rear casing 10 in a substantially horizontal direction and in parallel to each other. A first shielding plate 11*b* extends upward from the extended end or the innermost end of each of the first air introduction plates 11*a*. Further, each shielding plate 11*b* has an outside edge that has an arc-shape configuration similar to the inner wall of the rear casing 10. With this arrangement, the air introduced into the rear casing 10 via the first air introduction openings 11 flows upward (clockwise direction as viewed in FIG. 2) along the inner wall of the rear casing 10 as indicated by outline arrows in FIG. 2.

In addition, in this embodiment, six second air introduction openings 12 are formed in the rear casing 10 and each are configured as a through hole elongated in the forward and rearward directions (left and right directions in FIG. 1), which is parallel to the motor axis or the output shaft 3*a* of the motor 3. The second air introduction openings 12 are arranged in three rows in the vertical direction and each row includes two second air introduction openings 12 arranged in the forward and rearward directions, so that the three rows of the second air introduction openings 12 are opposed to the first to third rows of the first air introduction openings 11. A plurality of second air introduction plates 12*a* are formed on the inner wall of the rear casing 10 at positions adjacent to the lower edges of the second air introduction openings 12. The second air introduction plates 12*a* extend inwardly of the rear casing 10 in a substantially horizontal direction and in parallel to each other. A second shielding plate 12*b* extends downward from the extended end or the innermost end of each of the second air introduction plates 12*a* and has an arc-shaped configuration along the inner wall of the rear casing 10. With this arrangement, the air introduced into the rear casing 10 via the second air introduction openings 12 flows downward (clockwise direction as viewed in FIG. 2) along the inner wall of the rear casing 10 as indicated by outline arrows in FIG. 2.

In this way, the air introduced from the left side of the rear casing 10 via the first air introduction openings 11 flows upward toward the upper region within the rear casing 10, while the air introduced from the right side of the rear casing 10 via the second air introduction openings 12 flows downward toward the lower region within the rear casing 10. Therefore, the air entering the first air introduction openings 11 and the air entering the second air introduction openings 12 flow within the rear casing 10 in the clockwise direction and may not collide with each other. As a result, even if the dust is conveyed within the rear casing 10 by the air entering the first and second air introduction openings 11 and 12, the dust may be dispersed (and thus not aggregated) within the rear casing 10. Therefore, it is possible to prevent the dust from building up or depositing onto the electrical components of the motor 3 and to eventually prevent potential electrical leakage or potential lock or burnout of the carbon brushes.

As described above, according to this embodiment, air (that may contain the dust) may enter from the outside to the inside of the rear casing 10 via the first and second air introduction openings 11 and 12. The air may then be guided by the first and second air introduction plates 11*a* and 12*a* so as to collide with the first and second shielding plates 11*a* and 12*a*, where the major part of the dust may be separated from the air.

The first shielding plates 11*a* are oriented upward while the second shielding plates 12*a* are oriented downward opposite to the orientation of the first shielding plates 11*a*. Therefore, the air entering the first air introduction openings 11 flows upward after collision with the first shielding plates 11*a*, while the air entering the second air introduction openings 12 flows downward after collision with the second shielding plates 12*a*. Therefore, the air entering the first air introduction openings 11 and the air entering the second air introduction openings 12 may merge with each other and move toward the front side of the body casing 2 as a spiral or circulating flow of the air within the rear casing 10.

Because the air entering the rear casing 10 from the left side and the air entering the rear casing 10 from the right side flow vertically in opposite directions, the flow from the left side and the flow from the right side do not collide with each other. Hence, the dust contained in the air may be dispersed within the rear casing 10 and not deposited on the electrical components of the motor 3. Therefore, this configuration reduces or prevents malfunctioning of the motor 3.

Figure 2:
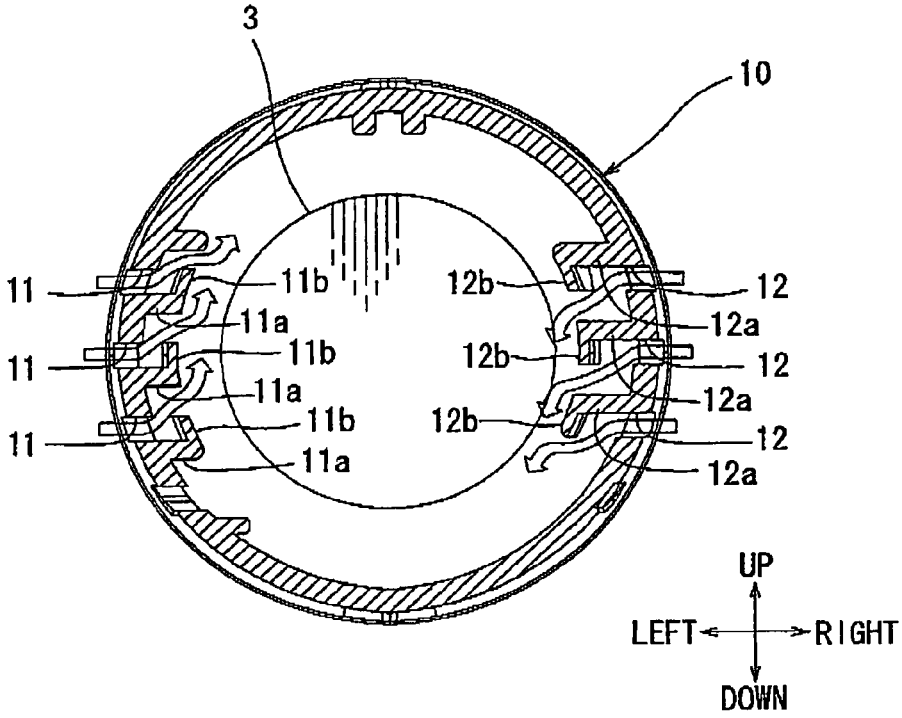
FIG. 2 is a cross sectional view taken along line (2)-(2) in FIG. 1 and showing a vertical sectional view of a rear casino.
Figure 3:
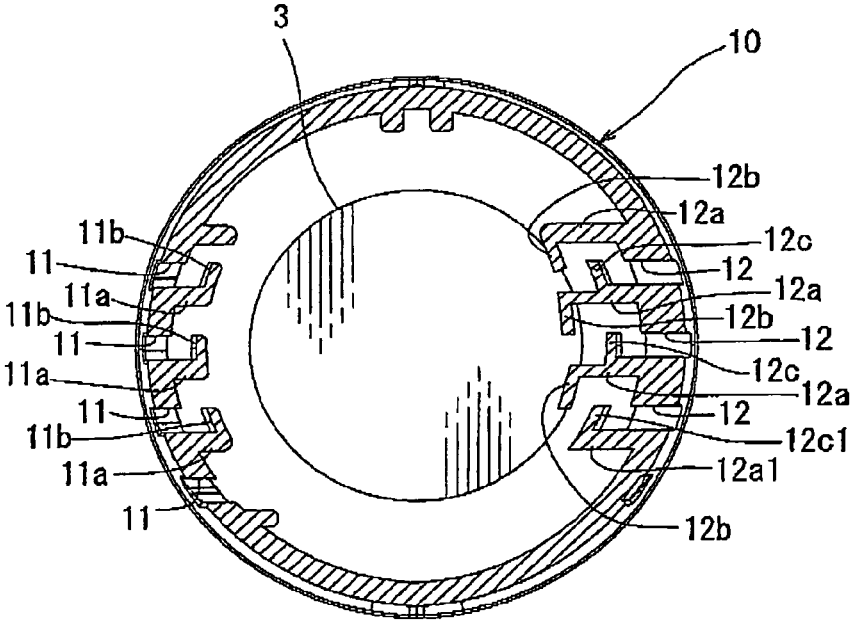
FIG. 3 is a cross sectional view similar to FIG. 2 but showing a vertical sectional view of a rear casing of a power tool according to another embodiment of the present invention.
Figure 4:
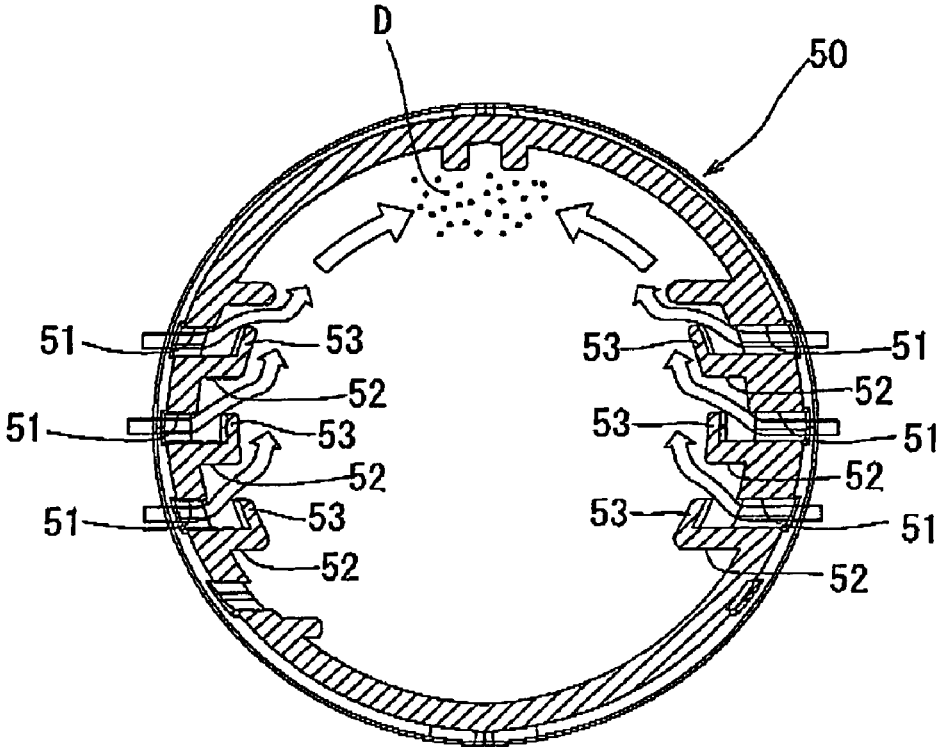
FIG. 4 is a vertical sectional view of a rear casing of a known power tool.

In addition, according to this embodiment, the air entering the rear casing 10 from the left side and the air entering the rear casing 10 from the right side flow is guided in the same direction with respect to the circumferential direction of the rear casing 10 (clockwise direction in FIGS. 2 and 3). Therefore, the air entering the rear casing 10 can smoothly flow within the rear casing 10 and the body casing 2 toward the front side of the body casing 2 as a spiral or circulating flow.

The above embodiment may be modified in various ways. For example, although one shielding plate 11*b* (12*b*) is provided for each air introduction opening 11 (12), two or more shielding plates may be provided. FIG. 3 shows an alternative embodiment in which two shielding plates are provided for each of the second air introduction openings 12. Thus, in this embodiment, the second air introduction plate 12*a* for each of the second air introduction openings 12 extends from a position offset upward by a predetermined distance from the lower edge of the corresponding second air introduction opening 12. More specifically, the second introduction plates 12*a* for the second row of the second air introduction openings 12 and those for the third row of the air introduction openings 12 extend from the lower edges of the first row of the air introduction openings 12 and the second row of the air introduction openings 1Z, respectively. An auxiliary shielding plate 12*c* extends upward (i.e., in opposite direction from the second shielding plates 12*b*) from an intermediate position of each of the air introduction plates 12*a* of the second and third rows. In addition, an additional air introduction plate 12*a*1 extends from the lower edge of each of the air introduction plates 12*a* in the third row. An additional auxiliary shielding plate 12*c*1 extends upward from the extended end or the innermost end of the additional introduction plate 12*a*1.

Because the auxiliary shielding plates 12*c* and 12*c*1 extend upward in opposite direction from the second shielding plates 12*b*, the auxiliary shielding plates 12*c* and 12*c*1 serve to initially separate the dust from the air before the air collides with the second shielding plates 12*b* for separation of the dust there.

Also with this embodiment, the air entering the second air introduction openings 12 is directed downward by the second shielding plates 12*b* after collision with the auxiliary shielding plates 12*c* and 12*c*1. Therefore, the flow of the air entering the first air introduction openings 11 and the flow of the air entering the second air introduction openings 12 merge with each other to produce a spiral or circulating flow of the air. Because the auxiliary shielding plates 12*c* and 12*c*1 are provided, it is possible to further reliably separate the dust from the air. Therefore, the potential improper operation of the motor 3 can be further minimized.

Although the auxiliary shielding plates 12*c* and 12*c*1 are provided for the second air introduction holes 12 in the above embodiment, it is possible to provide similar auxiliary shielding plates for the first air introduction holes 11 in addition to or in place of the auxiliary shielding plates 12*c* and 12*c*1.

The above embodiments may be further modified. For example, although the shielding plates 11*b* (12*b*) extend from the extended ends or the innermost ends of the substantially horizontal air introduction plates 11*a* (12*a*), each shielding plate 11*b* (12*b*) may extend directly from the inner wall of the rear casing 10. More specifically, each shielding plate 11*b* may extend obliquely upward from a position adjacent to the lower edge of the corresponding air introduction opening 11, and each shielding plate 12*b* may extend obliquely downward from a position adjacent to the upper edge of the corresponding air introduction opening 12.

Although the air entering the rear casing 10 from the left side is directed upward and the air entering the rear casing 10 from the right side is direction downward, it is possible to reverse the directions, so that the air may flow or circulate within the rear casing 10 in a counterclockwise direction as viewed in FIG. 2 or FIG. 3.

In addition, although the first and second air introduction openings 11 and 12 are formed in the right and left side portions of the rear casing 10, it is possible to form the first and second air introduction openings 11 and 12 in the upper and lower portions of the rear casing 10. Furthermore, the configuration of the rear casing 10 may have any other configuration than the cylindrical tubular configuration. For example, the rear casing 10 may have a polygonal configuration in cross section. Further, although the first and second air introduction openings 11 and 12 are formed in the rear casing 10, they may be formed in the body casing 2.

Further, the present invention can be applied to any other power tools than the disk grinder as long as they have a tubular case with openings from which the air enters for cooling a motor. For example, the present invention can be applied to drills, screwdrivers and cutting devices that have electric motors as driver sources.

The invention claimed is:

1. A power tool comprising:

a casing;

a motor disposed within the casing;

a first air introduction opening and a second air introduction opening formed in the casing on a first side and a second side opposite to the first side, respectively; and a first air introduction member and a second air introduction member extending inwardly from an inner wall of the casing at positions proximal to the first air introduction opening and the second air introduction opening, respectively;

wherein:

the first air introduction member is configured such that an external air flowing into an inside of the casing via the first air introduction opening is directed in a first direction within the casing;

the second air introduction member is configured such that an external air flowing into inside of the casing via the second air introduction opening is directed in a second direction within the casing;

first direction and the second direction are the same with respect to a circumferential direction of the casing;

the first and the second air introduction openings are spaced from each other in the circumferential direction of the casing; and the flow of air from the first air introduction opening and the flow of air from the second air introduction opening are merged to produced a spiral flow.

2. The power tool as in claim 1, wherein the first side and the second side are a left side and a right side of the casing, respectively, and the first direction and the second direction are an upward direction and a downward direction, respectively.

3. The power tool as in claim 2, wherein:

the first air introduction member extends from an inner wall of the casing at a position proximal to the lower side of the first air introduction opening; and the second air introduction member extends from the inner wall of the casing at a position proximal to the upper side of the second air introduction opening.

4. The power tool as in claim 3, wherein:

the first air introduction member includes a first air introduction plate extending from the inner wall of the casing and inclined upward toward the inside of the casing; and the second air introduction member includes a second air introduction plate extending from the inner wall of the casing and inclined downward toward the inside of the casing.

5. The power tool as in claim 3, wherein:

the first air introduction member includes a first air introduction plate extending substantially horizontally from the inner wall of the casing and a first shielding plate extending upward from an innermost end of the first air introduction plate; and the second air introduction member includes a second air introduction plate extending substantially horizontally from the inner wall of the casing and a second shielding plate extending downward from an innermost end of the second air introduction plate.

6. The power tool as in claim 3, wherein the first direction and the second direction are determined such that the air entering the casing via the first and second air introduction openings flows in a spiral form within the casing in the same direction as a rotational direction of the motor.

7. A power tool comprising:

a casing;

a motor disposed within the casing;

a first air introduction device disposed on a first side of the casing and constructed to produce a flow of air within the casing in a first direction with respect to a circumferential direction of the casing; and a second air introduction device disposed on a second side of the casing opposite to the first side and constructed to produce a flow of the air within the casing in a second direction with respect to the circumferential direction of the casing;

wherein the first direction and the second direction are the same direction so that the flow of the air from the first air introduction device and the flow of the air from the second air introduction device are merged to produce a spiral flow.

8. The power tool as in claim 7, wherein:

the casing comprises a first case and a second case coupled to each other and each defining a flow path therein;

the motor is disposed within the first case; and the first and second air introduction devices are disposed at the second case.

9. The power tool as in claim 7, wherein the air introduction device further includes a fan rotatably driven by the motor, so that the external air is drawn into the casing as the fan rotates.

10. A power tool comprising:

a casing defining a first opening and defining a second opening, wherein the first opening is approximately opposite the second opening;

a motor disposed within the casing;

a first air introduction member positioned inside the casing proximate the first opening, wherein the first air introduction member is constructed to direct external air into the casing in a first direction; and a second air introduction member positioned inside the casing proximate the second opening, wherein the second air introduction member is constructed to direct external air into the casing in a second direction;

wherein:

the first direction and the second direction are the same with respect to a circumferential direction of the casing;

the first and the second openings are spaced from each other in the circumferential direction of the casing, and a flow of air from the first opening and a flow of air from the second opening are merged to produced a spiral flow.

11. The power tool as in claim 10, wherein:

the first air introduction member extends from an inner wall of the casing at a position proximal to the lower side of the first opening; and the second air introduction member extends from the inner wall of the casing at a position proximal to the upper side of the second opening.

12. The power tool as in claim 11, wherein:

the first air introduction member includes a first air introduction plate extending from the inner wall of the casing and inclined upward toward the inside of the casing; and the second air introduction member includes a second air introduction plate extending from the inner wall of the casing and inclined downward toward the inside of the casing.

13. The power tool as in claim 11, wherein:

the first air introduction member includes a first air introduction plate extending substantially horizontally from the inner wall of the casing and a first shielding plate extending upward from an innermost end of the first air introduction plate; and the second air introduction member includes a second air introduction plate extending substantially horizontally from the inner wall of the casing and a second shielding plate extending downward from an innermost end of the second air introduction plate.

14. The power tool as in claim 11, wherein the first direction and the second direction are determined such that the air entering the casing via the first and second openings flows in a spiral form within the casing in the same direction as a rotational direction of the motor.

* * * * *